US009815646B2

(12) United States Patent
Iwadate et al.

(10) Patent No.: US 9,815,646 B2
(45) Date of Patent: Nov. 14, 2017

(54) IMAGE FORMING APPARATUS

(71) Applicant: CANON KABUSHIKI KAISHA, Tokyo (JP)

(72) Inventors: Shinnosuke Iwadate, Toride (JP); Teruhito Kai, Kashiwa (JP); Hiroto Nishihara, Tsukuba (JP); Hiromi Shimura, Toride (JP); Keita Takahashi, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/138,607

(22) Filed: Apr. 26, 2016

(65) Prior Publication Data

US 2016/0342124 A1 Nov. 24, 2016

(30) Foreign Application Priority Data

May 20, 2015 (JP) ..... 2015-102885
May 20, 2015 (JP) ..... 2015-102886

(51) Int. Cl.
*B65H 1/04* (2006.01)
*B65H 3/06* (2006.01)
*G03G 15/00* (2006.01)

(52) U.S. Cl.
CPC ..... *B65H 3/0684* (2013.01); *B65H 1/04* (2013.01); *G03G 15/6508* (2013.01); *G03G 15/6511* (2013.01); *G03G 15/6514* (2013.01); *B65H 2407/21* (2013.01); *B65H 2511/10* (2013.01); *G03G 2215/00734* (2013.01)

(58) Field of Classification Search
CPC ..... B65H 3/0684; B65H 2511/10; G03G 2215/00734; G03G 15/6514
See application file for complete search history.

(56) References Cited

U.S. PATENT DOCUMENTS 5,689,759 A * 11/1997 Isemura ..... G03G 15/6514 271/171
7,364,155 B2 * 4/2008 Nagao ..... B65H 1/08 271/126
8,576,427 B2 11/2013 Sakai
8,605,306 B2 12/2013 Takahashi
(Continued)

FOREIGN PATENT DOCUMENTS

JP 7-97079 4/1995

*Primary Examiner* — Jeremy R Severson
(74) *Attorney, Agent, or Firm* — Fitzpatrick, Cella, Harper & Scinto

(57) ABSTRACT

An image forming apparatus, including: an image forming control portion; a stacking portion; a sheet feeding unit; a change unit configured to change a state of the sheet feeding unit between a first state in which the sheet feeding unit is in abutment with the recording medium stacked on the stacking portion and a second state in which the sheet feeding unit is separated away from the recording medium; a decision unit configured to decide a size of the recording medium stacked on the stacking portion; and a control unit configured to control the change unit so that, when the size of the recording medium is changed from an undecided state to a decided state by the decision unit, the state of the sheet feeding unit is changed from the second state to the first state even without an instruction to start image formation from the image forming control portion.

16 Claims, 11 Drawing Sheets

(56) References Cited

U.S. PATENT DOCUMENTS

| | | | | |
|---|---|---|---|---|
| 2012/0187622 | A1* | 7/2012 | Kamichi | B65H 1/04 271/171 |
| 2016/0012320 | A1 | 1/2016 | Takahashi | |

* cited by examiner

IMAGE FORMING APPARATUS

BACKGROUND OF THE INVENTION

Field of the Invention

The present invention relates to an image forming apparatus configured to form an image on a recording medium fed from a stacking portion.

Description of the Related Art

An electrophotographic image forming apparatus is configured to feed a sheet that is placed in a sheet feeding cassette or on a manual feed tray so as to form an image on the fed sheet. In particular, the manual feed tray is widely used to form an image on a cardboard sheet having a basis weight that is not accepted by the sheet feeding cassette, a coated paper sheet, and the like. For example, in Japanese Patent Application Laid-Open No. H07-097079, there is disclosed a drive transmission mechanism using the same drive source for a sheet feeding pickup roller configured to feed a sheet placed on the manual feed tray and for a sheet feeding roller arranged on a downstream side in a conveying direction of the fed sheet. In Japanese Patent Application Laid-Open No. H07-097079, there is proposed the configuration described above for feeding an uppermost sheet on the manual feed tray in a one-by-one manner each time the sheet feeding pickup roller feeds the sheet to vertically rock a support arm for the sheet feeding pickup roller.

Meanwhile, hitherto, first copy output time (hereinafter referred to as "FCOT") from the pressing of a copy key to output of the first sheet is desired to be shortened. Even when the sheet is fed from the above-mentioned manual feed tray, it is desired to shorten the FCOT.

However, the conventional image forming apparatus is configured to vertically move the sheet feeding pickup roller each time one sheet is fed from the manual feed tray, and wait in an upper-limit position serving as an initial position while a sheet feeding operation is not performed (during a non-sheet feeding operation). Therefore, the sheet feed is delayed by a time period required for the sheet feeding pickup roller to be moved from the initial position down onto the sheet and a time period required for the sheet feeding pickup roller to wait on the sheet until oscillation is stopped so that the sheet feeding pickup roller starts rotating. Thus, there is a problem in that the FCOT is disadvantageously increased by the amount of delay time.

SUMMARY OF THE INVENTION

The present invention has been made under the above-mentioned circumstances, and has an object to shorten first copy output time.

According to one embodiment of the present invention, there is provided an image forming apparatus, comprising:

an image forming control portion;

a stacking portion on which a recording medium is stacked;

a sheet feeding unit configured to feed the recording medium stacked on the stacking portion to a conveyance path;

a change unit configured to change a state of the sheet feeding unit between a first state in which the sheet feeding unit is in abutment with the recording medium stacked on the stacking portion and a second state in which the sheet feeding unit is separated away from the recording medium stacked on the stacking portion;

a decision unit configured to decide a size of the recording medium stacked on the stacking portion; and a control unit configured to control the change unit so that, when the size of the recording medium is changed from an undecided state to a decided state by the decision unit, the state of the sheet feeding unit is changed from the second state to the first state even without an instruction to start image formation from the image forming control portion.

According to another embodiment of the present invention, there is provided an image forming apparatus, comprising:

an image forming control portion;

a stacking portion on which a recording medium is stacked;

a sheet feeding unit configured to feed the recording medium stacked on the stacking portion to a conveyance path;

a change unit configured to change a state of the sheet feeding unit between a first state in which the sheet feeding unit is in abutment with the recording medium stacked on the stacking portion and a second state in which the sheet feeding unit is separated away from the recording medium stacked on the stacking portion;

a decision unit configured to decide a size of the recording medium stacked on the stacking portion;

a determination unit configured to determine whether or not an operation from which execution of image formation is predicted is performed; and a control unit configured to control the change unit so that, when the determination unit determines that the operation is performed and the size of the recoding medium is decided by the decision unit, the state of the sheet feeding unit is changed from the second state to the first state even without an instruction to start the image formation from the image forming control portion.

Further features of the present invention will become apparent from the following description of exemplary embodiments with reference to the attached drawings.

DESCRIPTION OF THE EMBODIMENTS

A mode for carrying out the present invention will be described below in detail with reference to the drawings.

Embodiment

<Schematic Configuration of Image Forming System>

Figure 1:
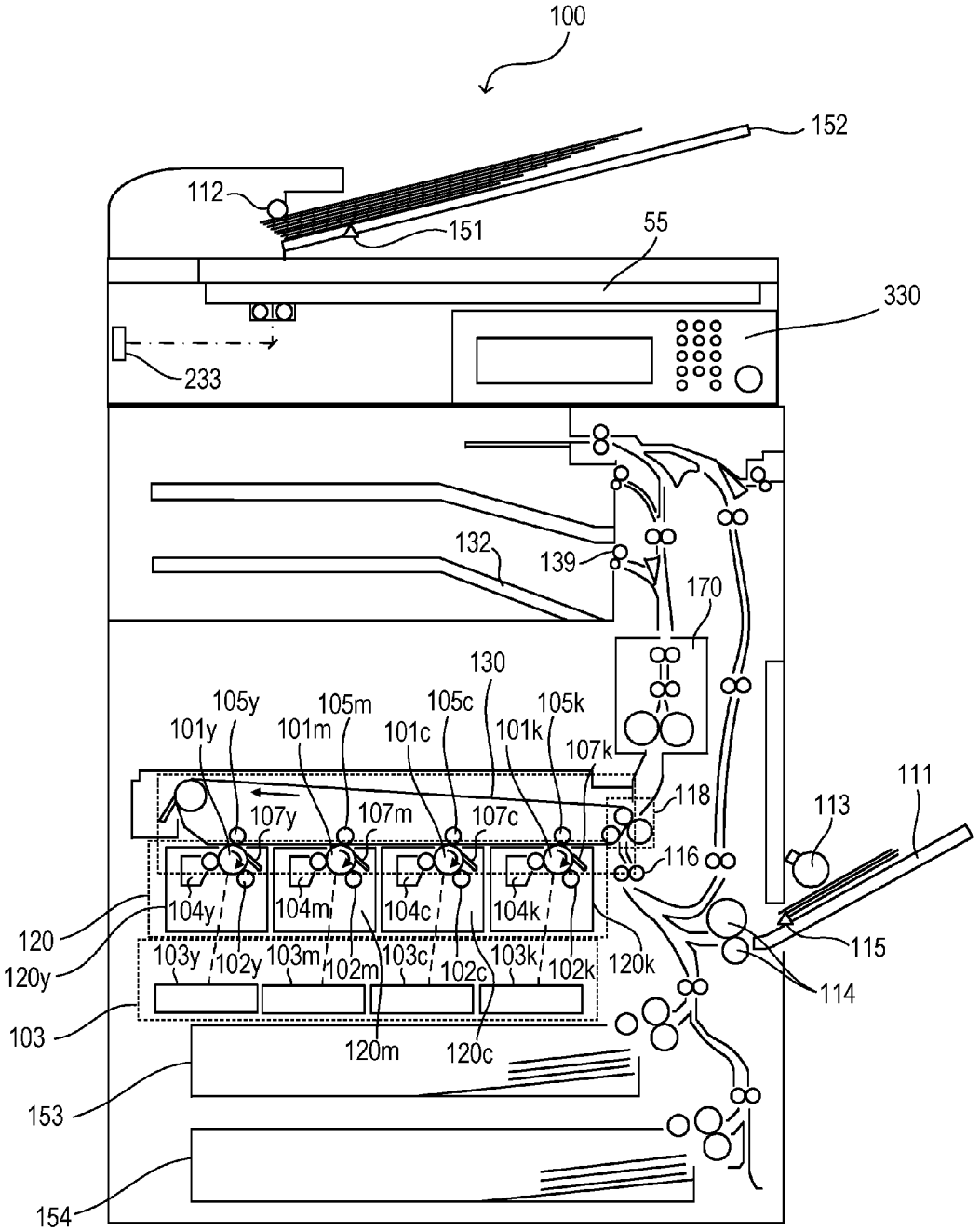
FIG. 1 is a sectional view of an image forming apparatus according to an embodiment of the present invention.
Figure 2:
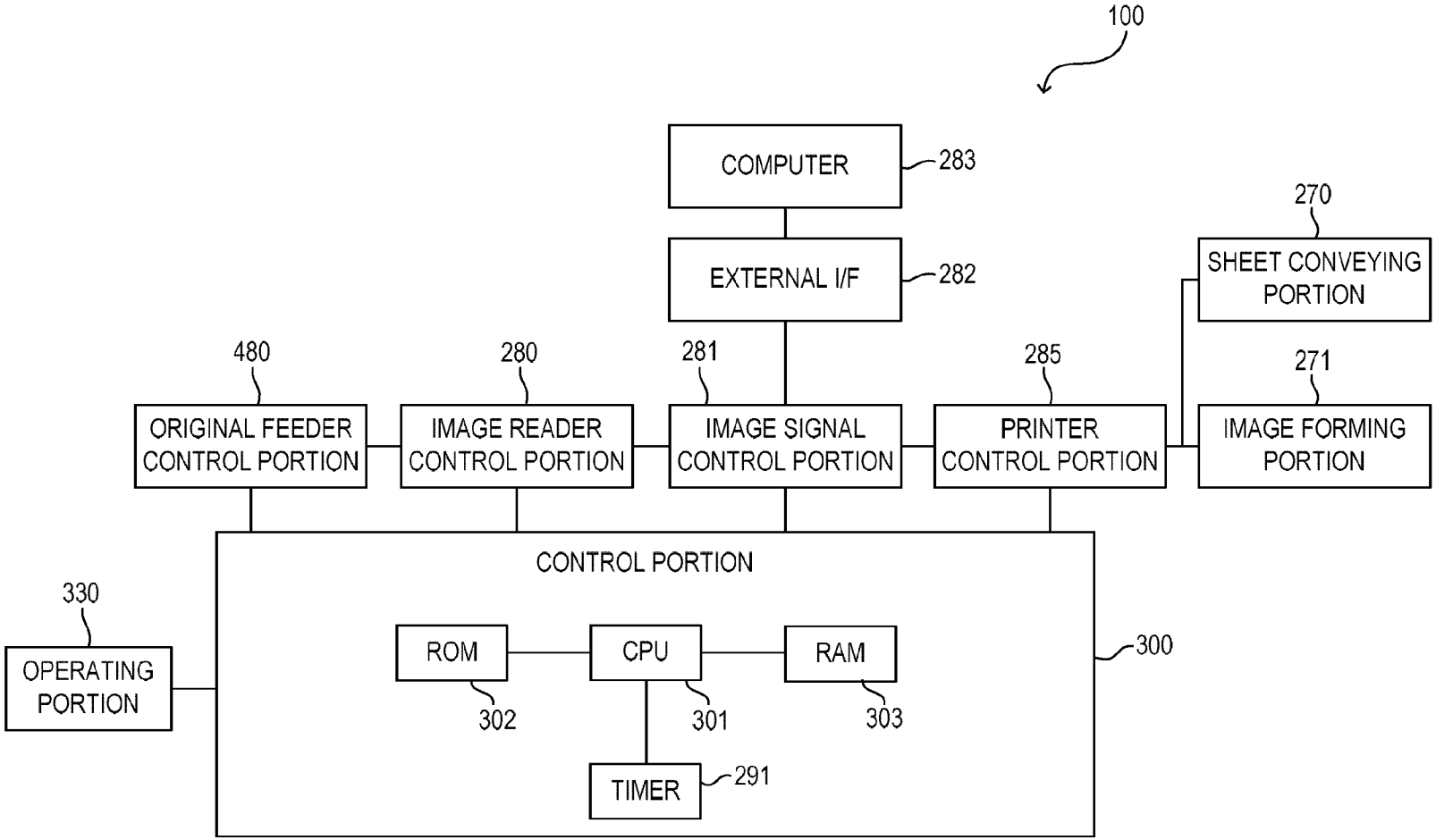
FIG. 2 is a block diagram of the image forming apparatus according to the embodiment.

FIG. 1 is a sectional view of an image forming apparatus 100 according to an embodiment of the present invention, and FIG. 2 is a block diagram of the image forming apparatus 100 according to the embodiment. Referring to FIG. 1 and FIG. 2, a basic configuration of the image forming apparatus 100 will be described.

[Schematic Configuration of Image Forming Apparatus]

A control portion 300 illustrated in FIG. 2 is configured to perform system control on the image forming apparatus 100 illustrated in FIG. 1. The control portion 300 includes a CPU 301, a ROM 302, a RAM 303, and a timer 291. The CPU 301 is configured to perform system control on the image forming apparatus 100. The ROM 302 and the RAM 303 are connected to the CPU 301 through an address bus and a data bus. Control programs are written in the ROM 302. The RAM 303 is configured to store variables to be used for the control and image data read by an image sensor 233 illustrated in FIG. 1. Further, the timer 291 capable of measuring time is connected to the CPU 301. Thus, the CPU 301 also sets a time count value of the timer 291 and acquires a measurement value of the timer 291. The CPU 301 drives an original conveying roller 112 and detects an original by an original sensor 151 via an original feeder control portion 480. Further, the CPU 301 controls an image reader control portion 280 to detect an opening and closing operation of an original pressure plate and read an image of the original on an original pressure plate glass plate 55 and an original image fed by the original feeder control portion 480 by an image sensor 233. The image sensor 233 outputs information of the read original image to the CPU 301 as an analog image signal. The CPU 301 transfers the analog image signal which is input from the image sensor 233 to an image signal control portion 281. The original pressure plate glass plate 55, an original table 152, the original sensor 151, the original conveying roller 112, and the image sensor 233 construct a reading portion configured to read the image of the original.

During a copy operation, the image signal control portion 281 performs various processes after the analog image signal input from the image sensor 233 is converted into a digital signal. After converting the digital image signal which has been subjected to the various processes into a video signal, the image signal control portion 281 outputs the video signal to a printer control portion 285. In this case, the copy operation is an operation of reading the original with the image sensor 233, and performing a print operation based on the read data. Further, during the print operation performed in response to an instruction from outside, the image signal control portion 281 first performs the various processes on the digital image signal which is input from a computer 283 through an external I/F 282. Then, the image signal control portion 281 converts the digital image signal which has been subjected to the various processes into the video signal, and outputs the thus obtained video signal to the printer control portion 285.

The printer control portion (image forming control portion) 285 instructs an image forming portion 271 to form an image based on an instruction output from the CPU 301. The image forming portion 271 drives an image forming unit 120 based on the input video signal. Further, the printer control portion 285 controls a sheet conveying portion 270 to perform sheet feeding control and conveyance control for a sheet which is a recording medium and performs a raising and lowering operation for a sheet feeding pickup roller 113 illustrated in FIG. 1, which will be described later, based on an instruction output from the CPU 301. Specifically, the printer control portion 285 detects whether or not a sheet is present on a sheet feeding tray 111 illustrated in FIG. 1, which is a stacking portion, with a sheet sensor 115 which is a second detection unit. When the presence of the sheet on the sheet feeding tray 111 is detected by the sheet sensor 115 and conditions described below are satisfied, the printer control portion 285 uses a raising and lowering motor 163 (see FIG. 5B) as a drive source to perform a lowering operation of the sheet feeding pickup roller 113 which is a sheet feeding unit. Thereafter, the printer control portion 285 uses a sheet conveying motor 164 (see FIG. 3A) as a drive source to rotationally drive the sheet feeding pickup roller 113 and a pair of sheet feeding rollers 114, thereby feeding the sheet to a conveyance path. An operating portion 330 is used to select an operation mode for image formation such as a color mode, display a state of the image forming apparatus 100, and instruct to start copy. Further, when the CPU 301 detects the placement of the sheet on the sheet feeding tray 111, a sheet size selection screen is displayed on the operating portion 330. A setting value for a mode selected by using the sheet size selection screen of the operating portion 330 is transmitted to the CPU 301. The CPU 301 stores the received setting value for the mode in the RAM 303.

The image forming apparatus 100 illustrated in FIG. 1 includes sheet feeding cassettes 153 and 154 as a sheet feeding portion in addition to the sheet feeding tray 111.

[Basic Image Forming Operation of Image Forming Apparatus]

Next, referring to FIG. 1 and FIG. 2, a basic image forming operation will be described. When the placement of the sheet on the sheet feeding tray 111 is detected by the sheet sensor 115, the CPU 301 controls the operating portion 330 to display the sheet size selection screen. After a sheet size is selected and decided by a user so that the sheet size is changed from an undecided state to a decided state, the CPU 301 performs the following control. Further, the CPU 301 may also be configured to perform the following control when the sheet size is selected and decided by the user and an operation from which sheet feed is predicted has been performed as described later.

Specifically, the CPU 301 moves a position of the sheet feeding pickup roller 113 to a "sheet feeding pickup roller abutment position" through a lowering operation of the sheet feeding pickup roller 113. The term "sheet feeding pickup roller abutment position" indicates a position at which the sheet feeding pickup roller 113 comes into abutment with the sheet placed on the sheet feeding tray 111 so that the sheet can be fed. The sheet feeding pickup roller 113 is placed in a first state of being in abutment with the sheet stacked on the sheet feeding tray 111.

Meanwhile, when detecting a print setting instruction input through the operating portion 330, such as the color mode and the number of print copies, and opening and closing of an original pressure plate or the placement of the original via the original feeder control portion 480 and the image reader control portion 280, the CPU 301 performs a print preparation operation. Specifically, the print preparation operation is an operation which is performed by the CPU 301 detecting the execution of an operation necessary to perform printing such as the instruction to set the print mode (operation on the operating portion), the opening and closing of the original pressure plate, the placement of the original, the placement of the sheet on the sheet feeding tray 111 before print start is instructed. The above-mentioned operations performed before the print start is instructed are operations from which execution of printing is predicted. The execution of printing is accompanied by sheet feed, and hence the above-mentioned operations can also be referred to as operations from which the sheet feed is predicted. For the reason described above, the CPU 301 functions as a determination unit. The CPU 301 starts temperature control for a fixing device 170 in the print preparation operation. Further, when the sheet is placed on the sheet feeding tray 111, the sheet size is in a decided state, and the sheet feeding pickup roller 113 is not present at the "sheet feeding pickup roller abutment position", the CPU 301 moves the sheet feeding pickup roller 113 to the "sheet feeding pickup roller abutment position". The raising and lowering operation of the sheet feeding pickup roller 113 and the print preparation operation will be described later in detail.

Next, when receiving the instruction to start the print operation from the operating portion 330 or the like, the CPU 301 starts an operation of reading an image of the original via the original feeder control portion 480. The CPU 301 drives the original conveying roller 112 to convey an original sheet from the original table 152 onto a platen glass plate, and irradiates the original sheet on the platen glass plate with light of a lamp (not shown). Reflected light from the original is guided to the image sensor 233 through a mirror. Image data of the original that is read by the image sensor 233 is output to the image signal control portion 281. The reading of the original is continued until the reading of the original on the original pressure plate glass plate 55 is completed or until reading of an image of a final original detected by the original sensor 151 is completed.

Meanwhile, the CPU 301 controls the image forming unit 120 via the image forming portion 271 to start an image forming operation for the image data stored in the RAM 303. Specifically, the image forming unit 120 includes a yellow image forming unit 120*y*, a magenta image forming unit 120*m*, a cyan image forming unit 120*c*, and a black image forming unit 120*k*. The suffixes y, m, c, and k respectively indicating colors are hereinafter omitted unless otherwise needed. The image forming unit 120 includes a photosensitive drum 101, a developing device 104, a charging roller 102, a photosensitive drum cleaner 107, and the like. In the image forming unit 120, after a surface of the photosensitive drum 101 configured to rotate in a direction indicated by the arrow in FIG. 1 (clockwise direction) is charged by the charging roller 102, a latent image is formed on the photosensitive drum 101 by laser light radiated from a laser scanner unit 103. Then, the latent image formed on the photosensitive drum 101 is developed on the photosensitive drum 101 with a toner contained in the developing device 104. Thereafter, toner images of the respective colors respectively developed on the photosensitive drums 101 are sequentially transferred onto an intermediate transfer belt 130 configured to rotate in a direction indicated by the arrow (counterclockwise direction) in a superimposed manner by primary transfer rollers 105 respectively applied with primary transfer voltages, thereby forming a full-color toner image. The full-color toner image transferred onto the intermediate transfer belt 130 is transferred onto a secondary transfer portion 118 through rotation of the intermediate transfer belt 130.

Further, the CPU 301 drives a conveying motor (not shown) via the sheet conveying portion 270 so as to be in synchronization with timing of arrival of the toner image at the secondary transfer portion 118. The sheet feeding pickup roller 113, the pair of sheet feeding rollers 114, a pair of registration rollers 116, and a pair of delivery rollers 139 are driven by the conveying motor that is a drive source. As a result, the sheet feeding pickup roller 113 is rotationally driven to feed and convey the sheet from the sheet feeding tray 111 in a one-by-one manner. In the manner described above, the full-color toner image on the intermediate transfer belt 130 is transferred onto the conveyed sheet through application of a secondary transfer voltage in the secondary transfer portion 118.

The sheet onto which the toner image has been transferred in the secondary transfer portion 118 is conveyed to the fixing device 170. In the fixing device 170, the unfixed toner image on the sheet is heated and pressurized so as to be fixed onto the sheet. Thereafter, the CPU 301 delivers the sheet to a delivery tray 132 by the pair of delivery rollers 139 which are controlled by the sheet conveying portion 270. After the print operation is completed, the CPU 301 performs the following operation in response to a power saving request described later. Specifically, the CPU 301 controls the sheet feeding pickup roller 113 to move from the "sheet feeding pickup roller abutment position" at which the sheet feeding pickup roller 113 is in contact with the sheet on the sheet feeding tray 111 to a "sheet feeding pickup roller separation position" at which the sheet feeding pickup roller 113 is located above the sheet. The sheet feeding pickup roller 113 is placed in a second state in which the sheet feeding pickup roller 113 is separated away from the sheet stacked on the sheet feeding tray 111. The "sheet feeding pickup roller abutment position" is hereinafter referred to simply as "abutment position", and the "sheet feeding pickup roller separation position" is hereinafter referred to simply as "separation position".

Further, the CPU 301 can switch between supply of power from a power source to the sheet conveying portion 270 or the image forming portion 271 via the printer control portion 285 and stop of the supply of the power. Sensors and drive sources are connected to the sheet conveying portion 270. Further, after elapse of a predetermined time (referred to "set time") set on the timer 291, the CPU 301 can also perform auto power saving control (hereinafter referred to as "autosleep") of stopping the supply of the power from the power source. As described above, the image forming apparatus 100 according to the embodiment can be operated in a normal power consumption mode for the image formation and a power saving mode in which power consumption is reduced from that during the image formation. Note that, the image forming operation and the power control described above are merely an example, and therefore the present invention is not limited to the configuration described above.

<Description of Sheet Feeding Pickup Roller Raising and Lowering Operation>

Next, a raising and lowering mechanism for the sheet feeding pickup roller 113 according to the embodiment will be described.

[Description of Sheet Feeding Tray 111]

Figure 3A:
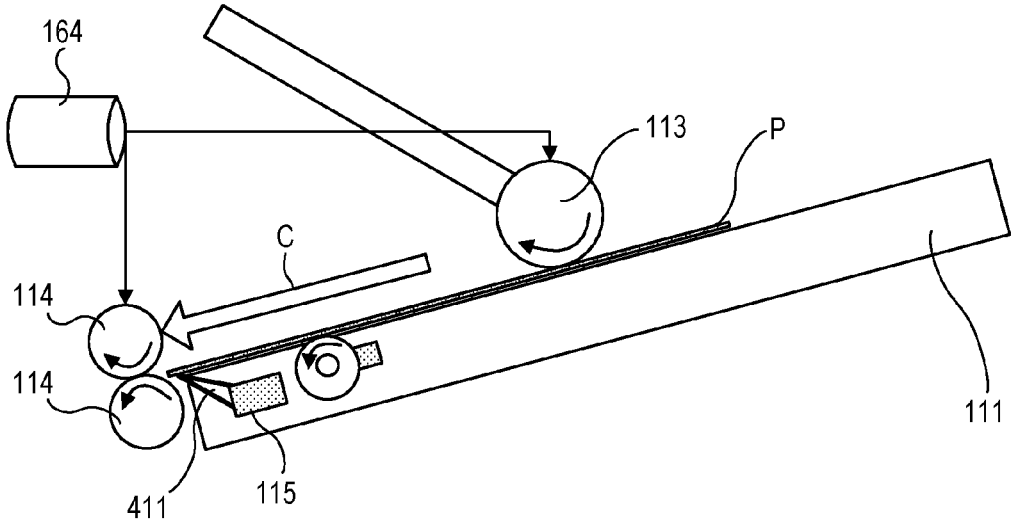
FIG. 3A is a sectional view of a vicinity of a sheet feeding tray according to the embodiment.

First, a configuration for detecting the sheet on the sheet feeding tray 111 according to the embodiment will be described referring to FIG. 3A and FIG. 3B. FIG. 3A is a sectional view of the vicinity of the sheet feeding tray 111. A sheet flag 411 is arranged to an end portion of the sheet feeding tray 111 on a side where the pair of sheet feeding rollers 114 are arranged. The sheet flag 411 is arranged, for example, in a central portion in a direction that is perpendicular to a direction of conveying a sheet P in the embodiment. The sheet sensor 115 is, for example, an optical sensor. When the sheet P is placed on the sheet feeding tray 111 as illustrated in FIG. 3A, the sheet flag 411 is pushed by a distal end portion of the sheet P in the direction of conveying the sheet P, and hence the sheet flag 411 shields the sheet sensor 115 from light. In this case, for example, the sheet sensor 115 outputs an ON signal.

On the other hand, when the sheet P is not present on the sheet feeding tray 111, the sheet flag 411 does not shield the sheet sensor 115 from light. In this case, for example, the sheet sensor 115 outputs an OFF signal. With the configuration described above, the CPU 301 is configured so as to be capable of detecting the presence/absence of the sheet on the sheet feeding tray 111. When detecting the placement of the sheet P on the sheet feeding tray 111, the CPU 301 controls the operating portion 330 to display the sheet size selection screen. The display on the operating portion 330 will be described later. Further, in a state in which the sheet feeding pickup roller 113 is in abutment with the sheet P, the sheet conveying motor 164 is driven. As a result, the sheet feeding pickup roller 113 and the pair of sheet feeding rollers 114 are respectively rotated in directions indicated by the arrows in FIG. 3A, thereby feeding and conveying the sheet P in a direction C indicated by the outlined arrow in FIG. 3A. The CPU 301 receives the signals from the sheet sensor 115 and controls the sheet conveying motor 164 via the sheet conveying portion 270 illustrated in FIG. 2.

Figure 3B:
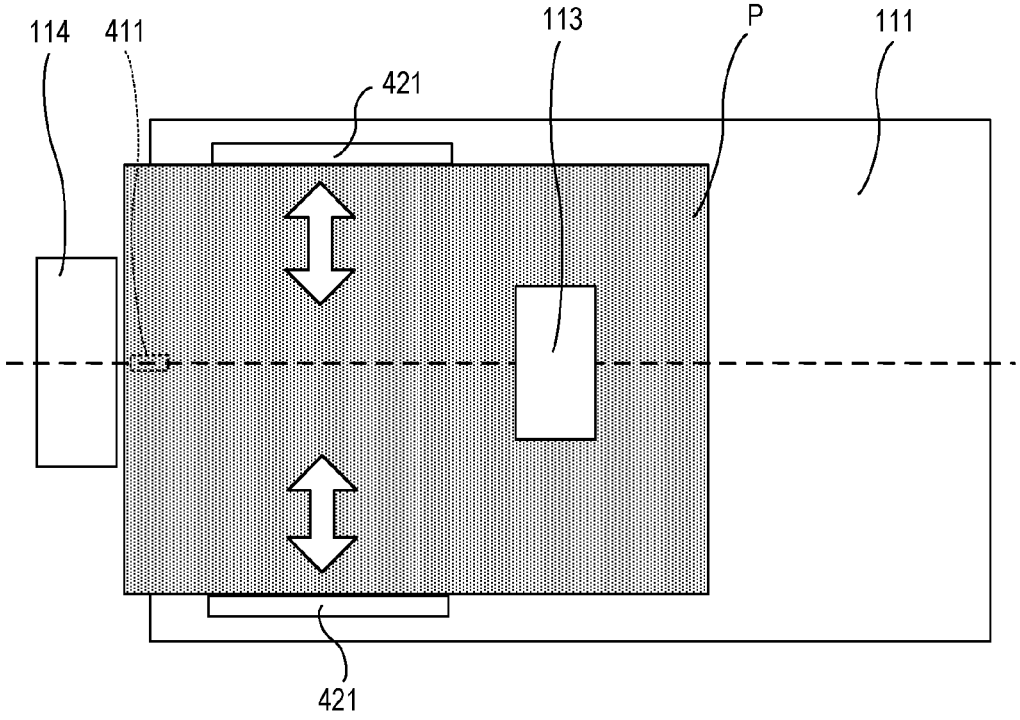
FIG. 3B is a top view of the vicinity of the sheet feeding tray according to the embodiment.

FIG. 3B is a projection view of the sheet feeding tray 111 as viewed from above, in which a central position in a width direction that is perpendicular to the conveying direction is indicated by the broken line. As illustrated in FIG. 3B, side regulating plates 421 configured to be movable in parallel to the sheet feeding tray 111 in a direction indicated by the outlined arrows are arranged on the sheet feeding tray 111. The side regulating plates 421 are located on a far side (upper side in FIG. 3B) and a near side (lower side in FIG. 3B) of the sheet P so as to sandwich the sheet P therebetween. In this manner, the side regulating plates 421 are configured to match an inclining direction of the sheet P placed on the sheet feeding tray 111 with the conveying direction and align the central position of the sheet P in the width direction with a central position of the sheet feeding tray in a width direction, which corresponds to a central position of an image forming region of the image forming unit 120 illustrated in FIG. 1 in a width direction. With the configuration described above, the image is formed at a correct position on the sheet P fed from the sheet feeding tray 111. Further, positions of the side regulating plates 421 can be detected by a position sensor (not shown). The CPU 301 detects information for deciding the size of the sheet P from the positions of the side regulating plates 421. Based on the detected information, contents to be displayed on the sheet size selection screen on the operating portion 330 are changed. The CPU 301 detects a length of the sheet P in a direction perpendicular to the direction of conveying the sheet P (corresponding to a width of the sheet P) as the information for deciding the size of the sheet P base on the positions of the side regulating plates 421. The CPU 301 also functions as a first detection unit configured to detect the information for deciding the size of the sheet P stacked on the sheet feeding tray 111. The display on the operating portion 330 will be described later.

[Description of Operating Portion 330]

[Decision of Sheet Size]

Figure 4A:
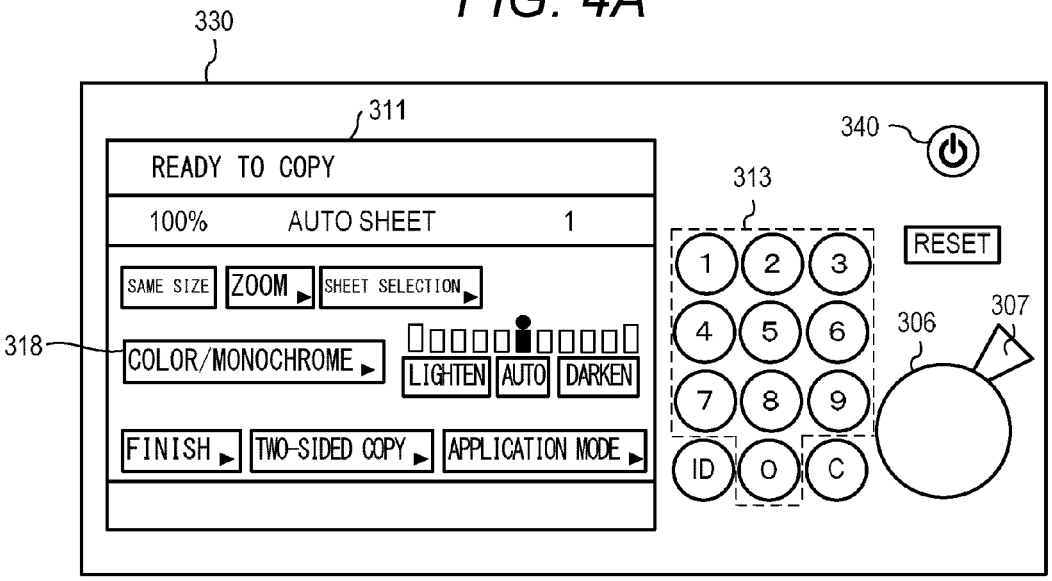
FIGS. 4A, 4B and 4C are schematic views of an operating portion according to the embodiment.

FIG. 4A is a front view of the operating portion 330 according to the embodiment. A start key 306 for starting the copy operation, a stop key 307 for stopping the copy operation, a numeric keypad 313 for setting digit entries, and the like are arranged on the operating portion 330. Further, a display portion 311 in which a touch panel is formed is arranged on the left of the operating portion 330. On a screen of the display portion 311, software keys which are software-based keys can be created. Further, the CPU 301 performs control for the print preparation operation in accordance with an operation on the numeric keys 313 for setting the digit entries and the like. Further, a power saving bottom 340 for changing the operation mode of the image forming apparatus 100 from the normal mode to the power saving mode and to return the operation mode of the image forming apparatus 100 from the power saving mode to the normal mode is also arranged on the operating portion 330.

Figure 4B:
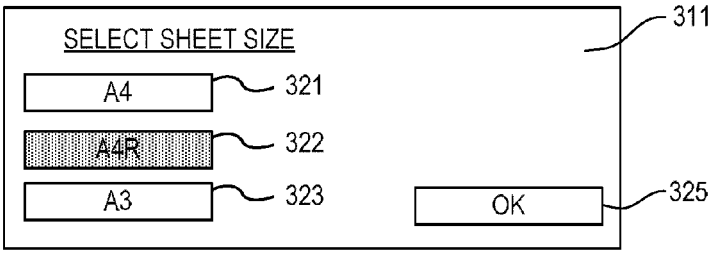
Figure 4C:
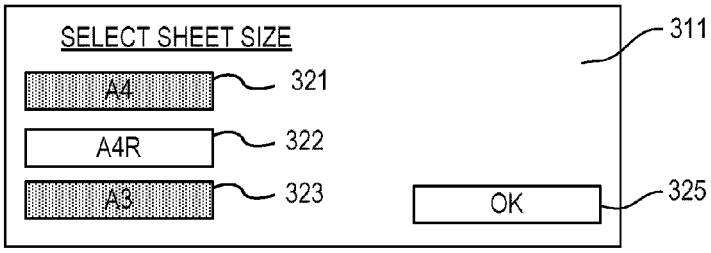

FIG. 4B and FIG. 4C are illustrations of the sheet size selection screen which is displayed on the display portion 311 when the sheet P is placed on the sheet feeding tray 111. As described above, the CPU 301 determines the contents to be displayed on the display portion 311 based on the detected positions of the side regulating plates 421 (information on the width of the sheet P). The CPU 301 controls the display portion 311 to display candidate sizes of the sheet P stacked on the sheet feeding tray 111 based on the information for deciding the size of the sheet P. An A4 button 321, an A4R button 322, and an A3 button 323, which indicate sheet sizes, and an OK button 325 are displayed on the display portion 311. By pressing the OK button 325 in a state in which any of the buttons 321 to 323 is selected, the sheet size is decided so that the selected sheet size is stored in the RAM 303. The A4 button 321, the A4R button 322, the A3 button 323, and the OK button 325 function as a selection portion (pressed portion) for selecting the size of the sheet P from the candidate sheet sizes displayed on the display portion 311 by a manual operation. With the buttons described above, the size of the sheet P stacked on the sheet feeding tray 111 is decided in response to the selection of the size of the sheet P from the candidate sizes displayed on the display portion 311. Therefore, the operating portion 330 functions as a decision unit configured to decide the sheet size.

FIG. 4B is an illustration of a screen displayed on the display portion 311 when the CPU 301 detects that the size of the sheet placed on the sheet feeding tray 111 is A4 or A3 based on the above-mentioned positions of the side regulating plates 421. In this case, as illustrated in FIG. 4B, the A4 button 321 and the A3 button 323 are in a selectable state. The A4R button 322 is grayed out, which indicates that the A4R button 322 is excluded from the buttons to be operated, and is therefore in an unselectable state. On the other hand, FIG. 4C is an illustration of a screen displayed on the display portion 311 when the CPU 301 detects that the size of the sheet placed on the sheet feeding tray 111 is A4R based on the above-mentioned positions of the side regulating plates 421. In this case, as illustrated in FIG. 4C, the A4R button 322 is in a selectable state, whereas the A4 button 321 and the A3 button 323 are grayed out and therefore in an unselectable state.

When the CPU 301 determines the absence of the sheet P based on the result of detection by the sheet sensor 115 after the sheet size is decided with the use of the sheet size selection screen of the display portion 311, the sheet size is determined as undecided. Then, information indicating that the sheet size is undecided is stored in the RAM 303. Such a situation corresponds to a case where, for example, the sheet P is removed from the sheet feeding tray 111 after the sheet size is decided, or the like. When the sheet P is placed on the sheet feeding tray 111 thereafter, the sheet size selection screen is displayed again on the display portion 311. The image forming apparatus 100 according to the embodiment cannot start the print operation before the sheet size is decided.

[Description of Raising and Lowering of Sheet Feeding Pickup Roller]

Figure 5A:
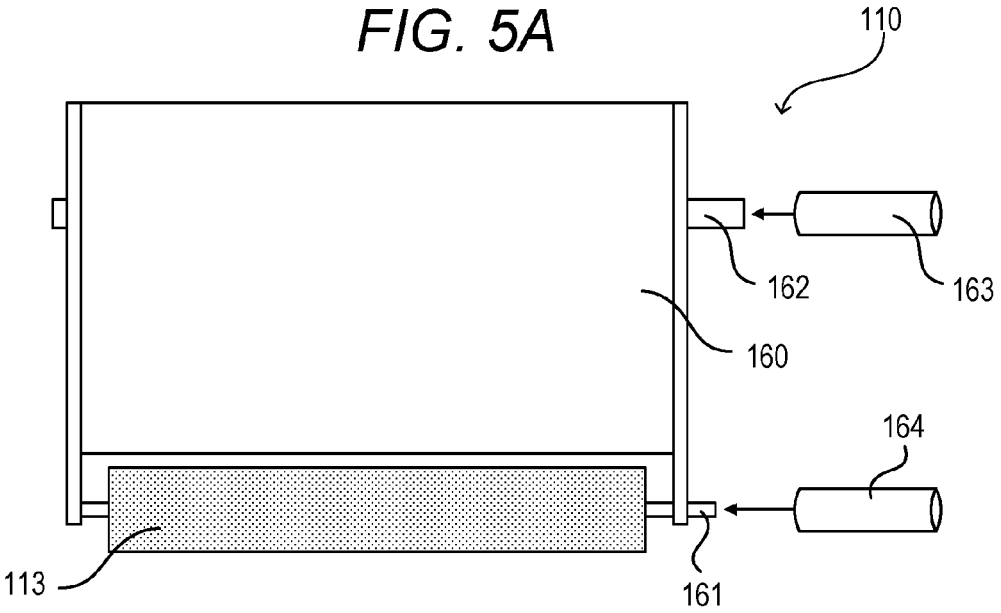
FIGS. 5A, 5B and 5C are explanatory diagrams of a raising and lowering operation of a sheet feeding pickup roller according to the embodiment.
Figure 5B:
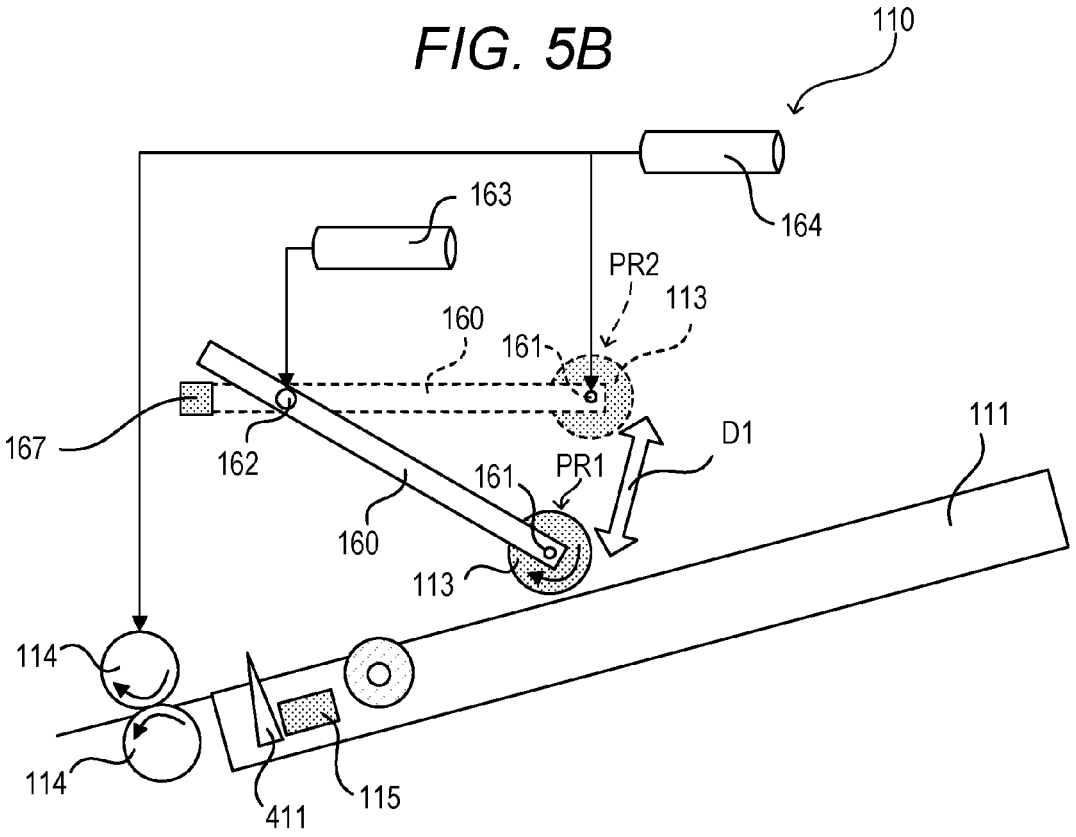
Figure 5C:
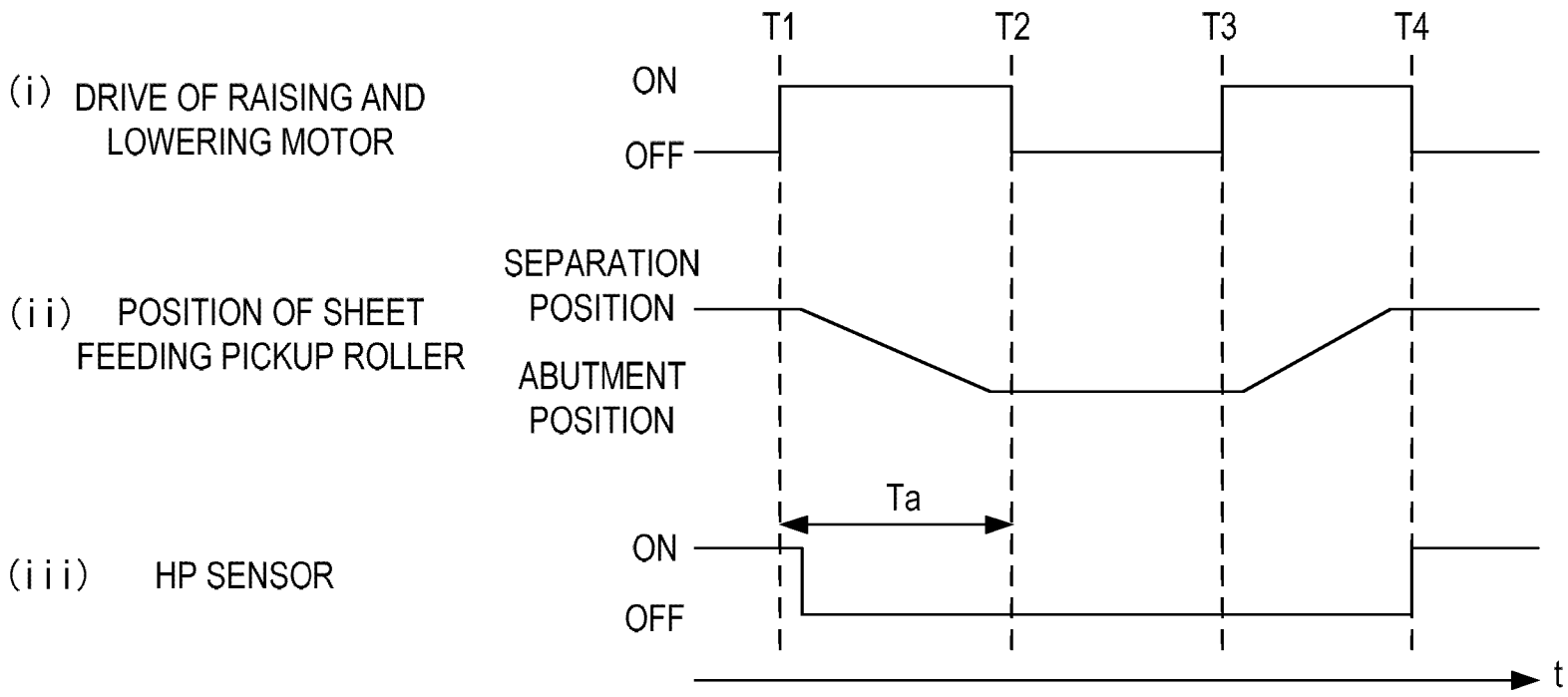

FIG. 5A, FIG. 5B, and FIG. 5C are explanatory diagrams for illustrating the raising and lowering operation of the sheet feeding pickup roller 113 according to the embodiment. FIG. 5A is a projection view of the sheet feeding pickup roller 113 of a manual feed portion 110 and a sheet feeding arm 160 configured to support the sheet feeding pickup roller 113, as viewed from above. The sheet feeding pickup roller 113 is supported by the sheet feeding arm 160 via a sheet feeding pickup roller shaft 161. A sheet feeding arm shaft 162 is fixed to the sheet feeding arm 160 so that drive of the raising and lowering motor 163 is transmitted to the sheet feeding arm shaft 162 via a cam (not shown).

Next, the raising and lowering operation of the sheet feeding pickup roller 113 will be described referring to FIG. 5B. FIG. 5B is a sectional view of the manual feed portion 110, in which an abutment position PR1 of the sheet feeding pickup roller 113 is indicated by the solid line and a separation position PR2 is indicated by the broken line. When the raising and lowering motor 163 serving as a drive unit rotates in a predetermined direction, the drive of the raising and lowering motor 163 is transmitted to the sheet feeding arm shaft 162 through the intermediation of the cam (not shown). As a result, the sheet feeding arm 160 and the sheet feeding pickup roller 113 reciprocate between the abutment position PR1 and the separation position PR2 within a certain angular range. The raising and lowering motor 163 functions as a change unit configured to change the position of the sheet feeding arm 160 and the sheet feeding pickup roller 113. The CPU 301 functions as a control unit configured to control the raising and lowering motor 163 to change a state of the sheet feeding pickup roller 113 between the first state in which the sheet feeding pickup roller 113 is in abutment with the sheet and the second state in which the sheet feeding pickup roller 113 is separated away from the sheet. More specifically, the sheet feeding arm shaft 162 is fixed to the sheet feeding arm 160. Through a rotating operation about the sheet feeding arm shaft 162 as a fulcrum, the sheet feeding arm 160 performs the raising and lowering operation. In conjunction with the raising and lowering operation of the sheet feeding arm 160, the sheet feeding pickup roller 113 is raised and lowered as indicated by the arrow Dl. A home position sensor (hereinafter referred to as "HP sensor") 167 for the sheet feeding pickup roller 113 is, for example, an optical sensor. The HP sensor 167 is configured to be shielded from light by the sheet feeding arm 160 when the sheet feeding pickup roller 113 is located in the above-mentioned separation position PR2 (corresponding to an initial position) which is the farthest away from the sheet feeding tray 111 within a predetermined movable range.

FIG. 5C is a timing chart relating to the raising and lowering of the sheet feeding pickup roller 113. In part (i) in FIG. 5C, a driving state of the raising and lowering motor 163 is illustrated. A high level (ON) indicates a time period in which the raising and lowering motor 163 is driven, whereas a low level (OFF) indicates a time period in which the raising and lowering motor 163 is not driven. In part (ii) of FIG. 5C, the positions of the sheet feeding pickup roller 113, specifically, the separation position PR2 and the abutment position PR1 described above are illustrated. In part (iii) of FIG. 5C, a state of the HP sensor 167 is illustrated. A high level (ON) indicates a time period in which the HP sensor 167 is shielded from light, whereas a low level (OFF) indicates a time period in which the HP sensor 167 is not shielded from light. For all of the part (i), part (ii), and part (iii), the horizontal axis indicates time "t".

For example, when the sheet feeding pickup roller 113 is present at the separation position PR2 (the HP sensor 167 is ON) after the state of the sheet size changes from the undecided state to the decided state, the CPU 301 starts driving the raising and lowering motor 163 at timing T1. Alternatively, the CPU 301 may be configured to start driving the raising and lowering motor 163 at the time T1 when the sheet feeding pickup roller 113 is present at the separation position PR2 (the HP sensor 167 is ON) in a case where the operation from which the execution of the image formation is predicted has been performed and the sheet size is in the decided state.

After the drive of the raising and lowering motor 163 is started, the sheet feeding pickup roller 113 starts being lowered from the separation position PR2 to change the HP sensor 167 from the shielded state to the unshielded state. At timing T2 at which a predetermined time Ta elapses from the timing T1, the CPU 301 determines that the sheet feeding pickup roller 113 has been lowered to the abutment position PR1 at which the sheet feeding pickup roller 113 is the closest to the sheet feeding tray 111. Then, the CPU 301 stops driving the raising and lowering motor 163 to maintain the sheet feeding pickup roller 113 at the abutment position. When determining that the sheet feeding pickup roller 113 has been lowered to the abutment position PR1, the CPU 301 stores information thereof in the RAM 303. In the embodiment, the CPU 301 determines that the sheet feeding pickup roller 113 has been moved to the abutment position PR1 based on the elapse of the predetermined time Ta from the start of the drive of the raising and lowering motor 163. However, for example, a sensor configured to detect the movement of the sheet feeding pickup roller 113 to the abutment position PR1 may be included instead.

Before receiving the instruction to start the print operation, the CPU 301 waits for the reception of the instruction to start the print operation in a state in which the sheet feeding pickup roller 113 is held in the abutment position PR1 after being moved to the abutment position PR1. In this manner, in comparison to a case where the sheet feeding pickup roller 113 is moved from the separation position PR2 to the abutment position PR1 after the reception of the instruction to start the print operation, first copy output time (hereinafter referred to as "FCOT") is shortened by the predetermined time Ta (=500 ms). In this case, the FCOT is time from the pressing of the start key 306 for starting the copy operation to output of the first sheet P. The predetermined time Ta is a time period required to move the sheet feeding pickup roller 113 from the separation position PR2 to the abutment position PR1. A value which is determined in advance through a measurement or the like is stored in the ROM 302 as the predetermined time Ta. The predetermined time Ta is determined in consideration of a variation in time period from a time at which the CPU 301 outputs a signal to start or stop the drive of the raising and lowering motor 163 to a time at which the raising and lowering operation of the sheet feeding pickup roller 113 is actually started or stopped and the like.

Next, when the CPU 301 starts driving the raising and lowering motor 163 again at timing T3 at which the feeding of the last sheet is completed in the print operation, the sheet feeding pickup roller 113 starts being raised from the abutment position. The CPU 301 determines that the sheet feeding pickup roller 113 has been raised to the separation position at timing T4 at which the CPU 301 detects that the HP sensor 167 is shielded from light. Then, the CPU 301 stops driving the raising and lowering motor 163 to maintain the position of the sheet feeding pickup roller 113 in the separation position PR2. However, the configurations of the raising and lowering motor 163, the sheet feeding pickup roller 113, and the HP sensor 167 and the conditions of the raising and lowering control described above are merely an example, and the present invention is not limited to the configurations described above. In the embodiment, the sheet feeding pickup roller 113 is configured to be raised and lowered so as to bring the sheet feeding pickup roller 113 and the sheet P into abutment with each other and separate the sheet feeding pickup roller 113 and the sheet P from each other. Instead, however, the sheet feeding tray 111 may be configured to be raised and lowered, while the position of the sheet feeding pickup roller 113 is fixed. In this case, a motor configured to raise and lower the sheet feeding tray 111 or the like functions as the change unit. The raising and lowering motor 163 may also be used as the drive unit configured to raise and lower the sheet feeding tray 111.

[Raising and Lowering Operation of Sheet Feeding Pickup Roller]

When the size of the sheet on the sheet feeding tray 111 changes from the undecided state to the decided state in the embodiment, the sheet feeding pickup roller 113 is moved in advance to the abutment position PR1 before the print operation is instructed to be started. Alternatively, the sheet feeding pickup roller 113 may be moved in advance to the abutment position PR1 before the print operation is instructed to be started when the size of the sheet on the sheet feeding tray 111 is in the decided state and the operation from which the execution of the image information is predicted has been performed. In this manner, the sheet can be fed immediately after the start of the print operation. Therefore, in comparison to a configuration in which the sheet feeding pickup roller 113 is moved to the abutment position PR1 after the reception of the instruction to start the print operation, the FCOT can be shortened by the time period required to bring the sheet feeding pickup roller 113 into abutment with the sheet.

As described above, after the sheet is placed on the sheet feeding tray 111, the CPU 301 first detects the presence of the sheet with the sheet sensor 115. Next, the sheet size is selected on the sheet size selection screen displayed on the operating portion 330 so that the sheet size is decided. Now, the reason why the condition for moving the sheet feeding pickup roller 113 to the abutment position PR1 is "change of the sheet size from the undecided state to the decided state" will be described. The following description also corresponds to a description of the reason why one of the conditions for moving the sheet feeding pickup roller 113 to the abutment position PR1 when the size of the sheet on the sheet feeding tray 111 is in the decided state and the operation from which the execution of the image formation is predicted has been performed is "decided sheet size".

When the sheet feeding pickup roller 113 is present at the abutment position PR1, the sheet feeding pickup roller 113 pressurizes the sheet feeding tray 111 to some degrees so as to feed the sheet on the sheet feeding tray 111. When the user removes the sheet on the sheet feeding tray 111 so as to place a new sheet thereon in this state, the sheet can be removed, but it is difficult to insert a sheet stack between the sheet feeding tray 111 and the sheet feeding pickup roller 113. Therefore, usability is lowered when the sheet feeding pickup roller 113 is present at the abutment position PR1 regardless of the state of the image forming apparatus 100 and the sheet on the sheet feeding tray 111.

Further, even when the sheet feeding pickup roller 113 is moved to the abutment position PR1 at timing immediately after the user places the sheet on the sheet feeding tray 111, the user cannot move the side regulating plates 421 so as to align the sheet position. Therefore, even when the sheet feeding pickup roller 113 is moved to the abutment position PR1 before the CPU 301 detects the presence of the sheet by the sheet sensor 115 so that the sheet size is decided, the usability is lowered.

As described above referring to FIG. 3A and FIG. 3B and FIG. 4A to FIG. 4C, the CPU 301 detects the size of the sheet P (width of the sheet P) based on the positions of the side regulating plates 421. The contents to be displayed on the sheet size selection screen which is displayed on the operating portion 330 are determined based on the detected sheet size. Therefore, in a stage in which the user decides the sheet size with the operating portion 330, there is a high possibility that positions of the side regulating plates 421 have already been set correctly. As a result, even when the sheet feeding pickup roller 113 is moved to the abutment position PR1 after the sheet size is decided, the FCOT can be shortened without lowering the usability.

The method of deciding the sheet size according to the embodiment is merely an example, and the method of deciding the sheet size is not limited to that using the side regulating plates 421 as in the embodiment. For example, a configuration without using the side regulating plates 421, which picks up an image on the sheet present on the sheet feeding tray 111 with an image pickup apparatus or the like so as to detect the sheet size can be used. In the image forming apparatus 100 having such a configuration, even when the sheet is placed obliquely on the sheet feeding tray 111, the image is formed in accordance with an angle at which the sheet is placed so that the toner image is transferred at a predetermined position on the sheet. Even in such a configuration, the sheet size may be decided as a size detected by a predetermined method.

[Control Process for Sheet Feeding Pickup Roller (when Placement of Sheet is Detected)]

Figure 6A:
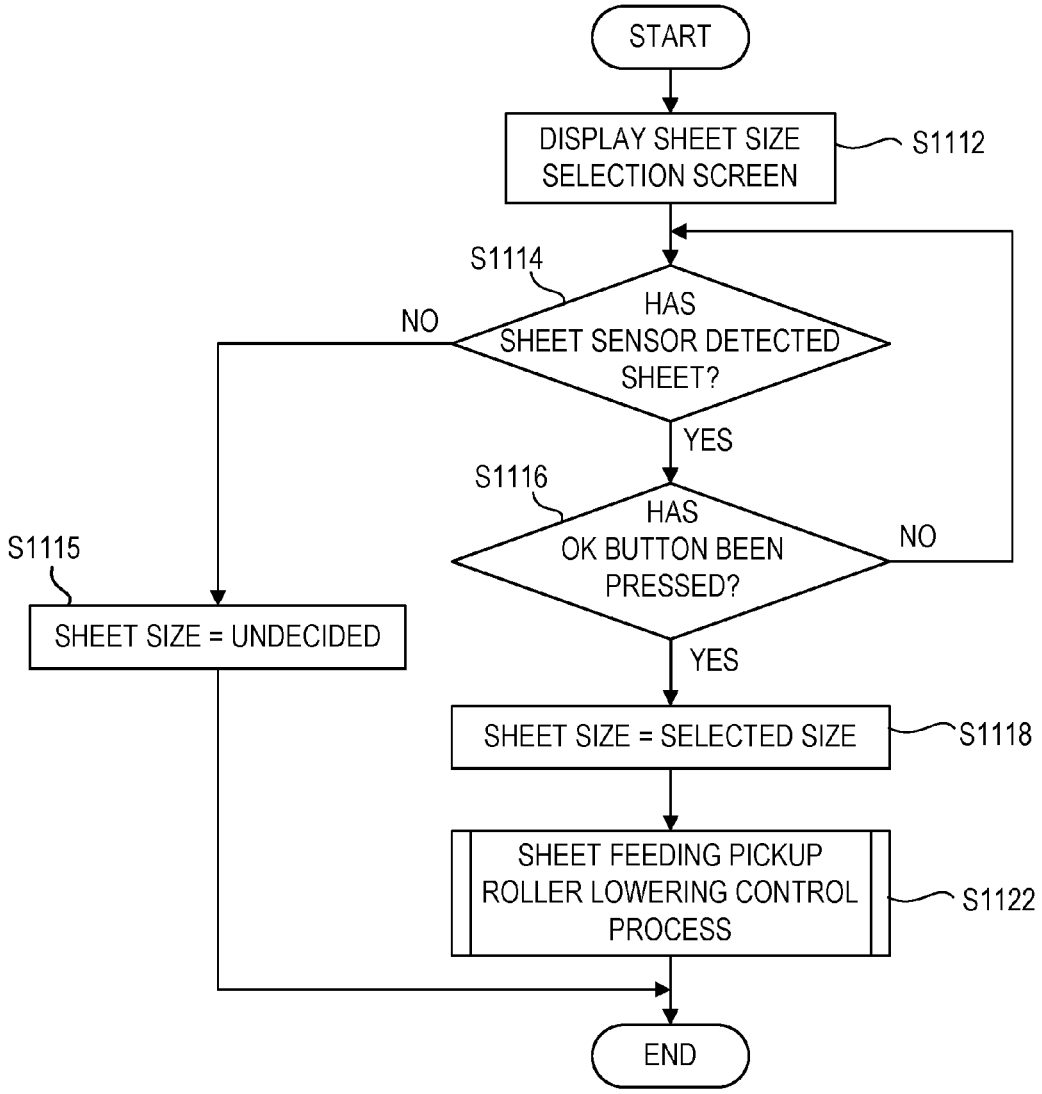
FIGS. 6A and 6B are flowcharts for illustrating a process of detecting a placement of a sheet on the sheet feeding tray and a lowering control process of a sheet feeding pickup roller according to the embodiment, respectively.
Figure 6B:
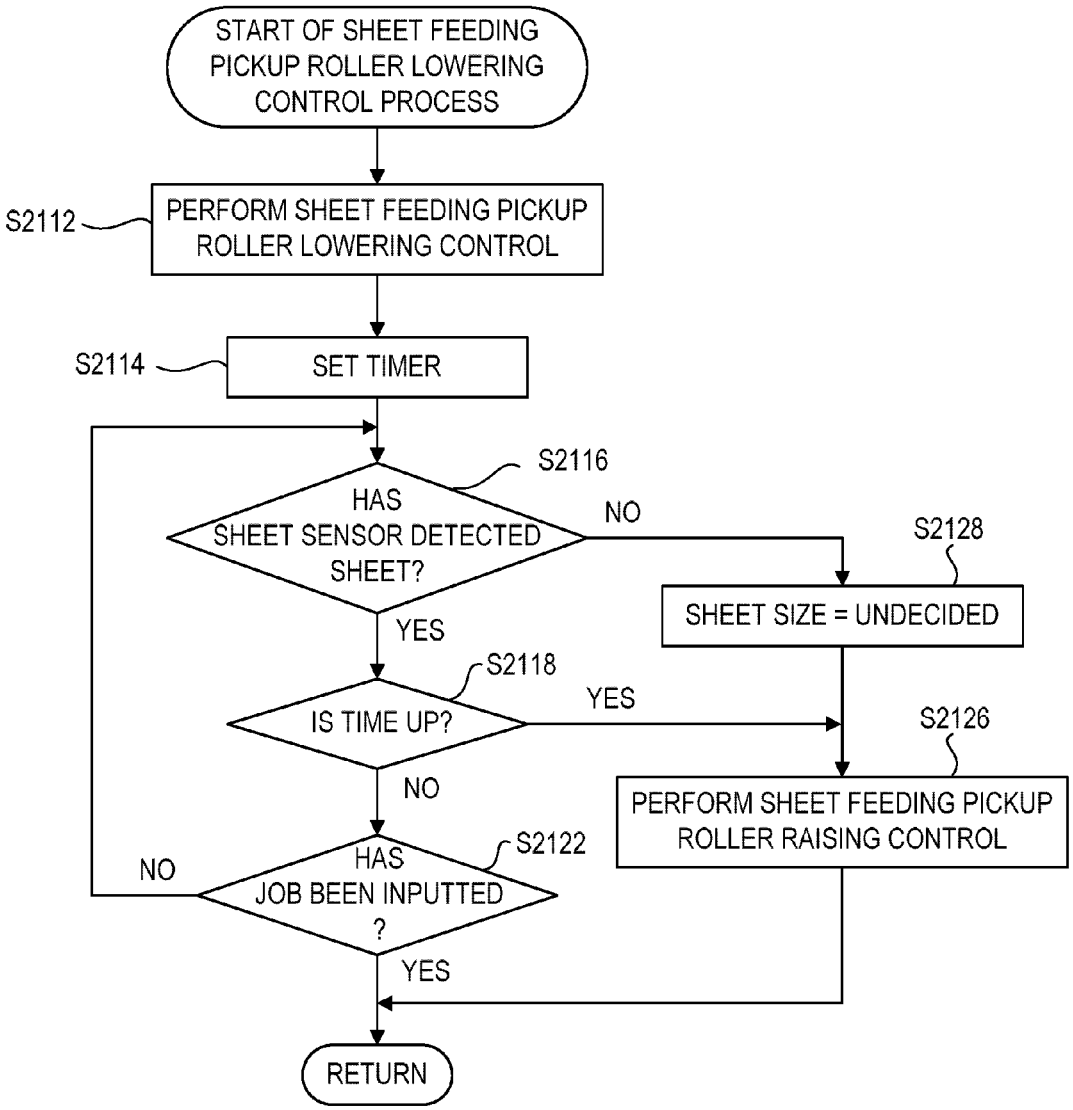

An example where a lowering control process for the sheet feeding pickup roller 113 is performed when the information on the sheet size, which is stored in the RAM 303, is changed from "undecided size" to "selected size", will be described referring to flowcharts. FIG. 6A and FIG. 6B are flowcharts for illustrating the lowering control process which is performed when the CPU 301 detects the placement of the sheet on the sheet feeding tray 111. First, the lowering control process will be described referring to FIG. 6A. When the sheet sensor 115 detects the presence of the sheet in a case where the information on the sheet size, which is stored in the RAM 303, indicates the "undecided size", the CPU 301 determines that the sheet has been placed on the sheet feeding tray 111. Then, after determining the placement of the sheet on the sheet feeding tray 111, the CPU 301 performs a process after Step (hereinafter referred to as S) 1112 in FIG. 6A. The information on the sheet size is hereinafter referred to simply as "sheet size information", and the information indicating "undecided size" is hereinafter referred to simply as "undecided size".

In S1112, the CPU 301 controls the operating portion 330 to display the sheet size selection screen, for example, as illustrated in FIGS. 4B and 4C, so as to prompt the user to select the sheet size. In S1114, the CPU 301 determines whether or not the sheet sensor 115 has detected the sheet, in a state in which the sheet size selection screen is being displayed on the operating portion 330. When determining in S1114 that the sheet sensor 115 has not detected the sheet (no sheet), the CPU 301 sets the "undecided size" as the sheet size information to be stored in the RAM 303 in S1115, and then terminates the process.

On the other hand, when the CPU 301 determines in S1114 that the sheet sensor 115 has detected the sheet (presence of the sheet), in other words, when a state in which the sheet is present is maintained even after the sheet size selection screen is displayed on the operating portion 330, the process proceeds to S1116. In S1116, the CPU 301 determines whether or not the OK button 325 on the sheet size selection screen of the operating portion 330 has been pressed. When the CPU 301 determines in S1116 that the OK button 325 has not been pressed, the process returns to S1114. On the other hand, when determining in S1116 that the OK button 325 has been pressed, the CPU 301 determines that the size of the sheet on the sheet feeding tray 111 has been decided. Then, the process proceeds to S1118.

In S1118, the CPU 301 stores the sheet size (selected size) selected on the operating portion 330, for example, "A4 size" when the A4 button 321 is selected on the sheet size selection screen on the operating portion 330, as the sheet size information in the RAM 303. In S1122, the CPU 301 performs a sheet feeding pickup roller lowering control process described below so as to move the sheet feeding pickup roller 113 to the abutment position.

[Sheet Feeding Pickup Roller Lowering Control Process]

FIG. 6B is a flowchart for illustrating the sheet feeding pickup roller lowering control process performed in S1122 in FIG. 6A. After the sheet size is decided, the CPU 301 performs lowering control of moving the sheet feeding pickup roller 113 to the abutment position PR1 even when the instruction to start printing is not input. The instruction to start printing is transmitted in response to the pressing of the start key 306 on the operating portion 330 in some cases and is transmitted from an external device such as the computer 283 through a network in some cases. In S2112, the CPU 301 performs the sheet feeding pickup roller lowering control of driving the raising and lowering motor 163 for the time period Ta, as described above referring to FIG. 5A to FIG. 5C. In S2114, the CPU 301 sets the predetermined time to the timer 291 to determine elapse of the predetermined time such as thirty seconds so as to prevent the sheet feeding pickup roller 113 from being left in the abutment position PR1 for a long time period. If the sheet feeding pickup roller 113 is left in an abutment state against the sheet for a long time period, there is a fear in that the sheet feeding pickup roller 113 leaves a mark on the uppermost sheet of the sheet stack on the sheet feeding tray 111. Therefore, when the predetermined time has elapsed in a state in which the sheet feeding pickup roller 113 is in abutment with the sheet without input of the instruction to start printing, the sheet feeding pickup roller 113 is moved to the separation position PR2 by the CPU 301. The process performed in S2114 is a process for setting the predetermined time to the timer 291 so as to make the above-mentioned determination.

In S2116, the CPU 301 determines whether or not the sheet has been detected by the sheet sensor 115. The process in S2116 is a process that is performed so as to deal with the removal of the sheet by the user before the time set on the timer 291 is up after the sheet feeding pickup roller 113 is lowered. The process in S2116 is performed because, when the user removes the sheet, control of raising the sheet feeding pickup roller 113 is required to be performed so that the user can place the sheet again. When the CPU 301 determines in S2116 that the sheet has not been detected by the sheet sensor 115 (no sheet), the process proceeds to S2128. In S2128, the CPU 301 sets the "undecided size" as the sheet size information to be stored in the RAM 303, and stores the sheet size information in the RAM 303. In S2126, the CPU 301 performs the raising control for the sheet feeding pickup roller 113, of moving the sheet feeding pickup roller 113 to the separation position PR2. As a result, the user can place the sheet on the sheet feeding tray 111 again. Specifically, as described referring to FIG. 5A to FIG. 5C, the CPU 301 drives the raising and lowering motor 163 until the CPU 301 detects a rising edge at which the HP sensor 167 rises from OFF to ON.

When determining in S2116 that the sheet has been detected by the sheet sensor 115 (presence of the sheet), the CPU 301 determines in S2118 whether or not the predetermined time has elapsed (whether or not the time set on the timer 291 is up) by referring to the timer 291. When the CPU 301 determines in S2118 that the time set on the timer 291 is up, the process proceeds to S2126. When the CPU 301 determines in S2118 that the time set on the timer 291 is not up, the process proceeds to S2122. In S2122, the CPU 301 determines whether or not a job has been input in response to the instruction to start the print operation (whether or not the instruction to start printing has been received). When the CPU 301 determines that the job has not been input, the process proceeds to S2116. When determining in S2122 that a print job has been input, the CPU 301 stops the timer that has been started in S2114, and then terminates the lowering processing for the sheet feeding pickup roller 113.

[Control Process for Sheet Feeding Pickup Roller (when Power is Turned on or the Like)]

Figure 7:
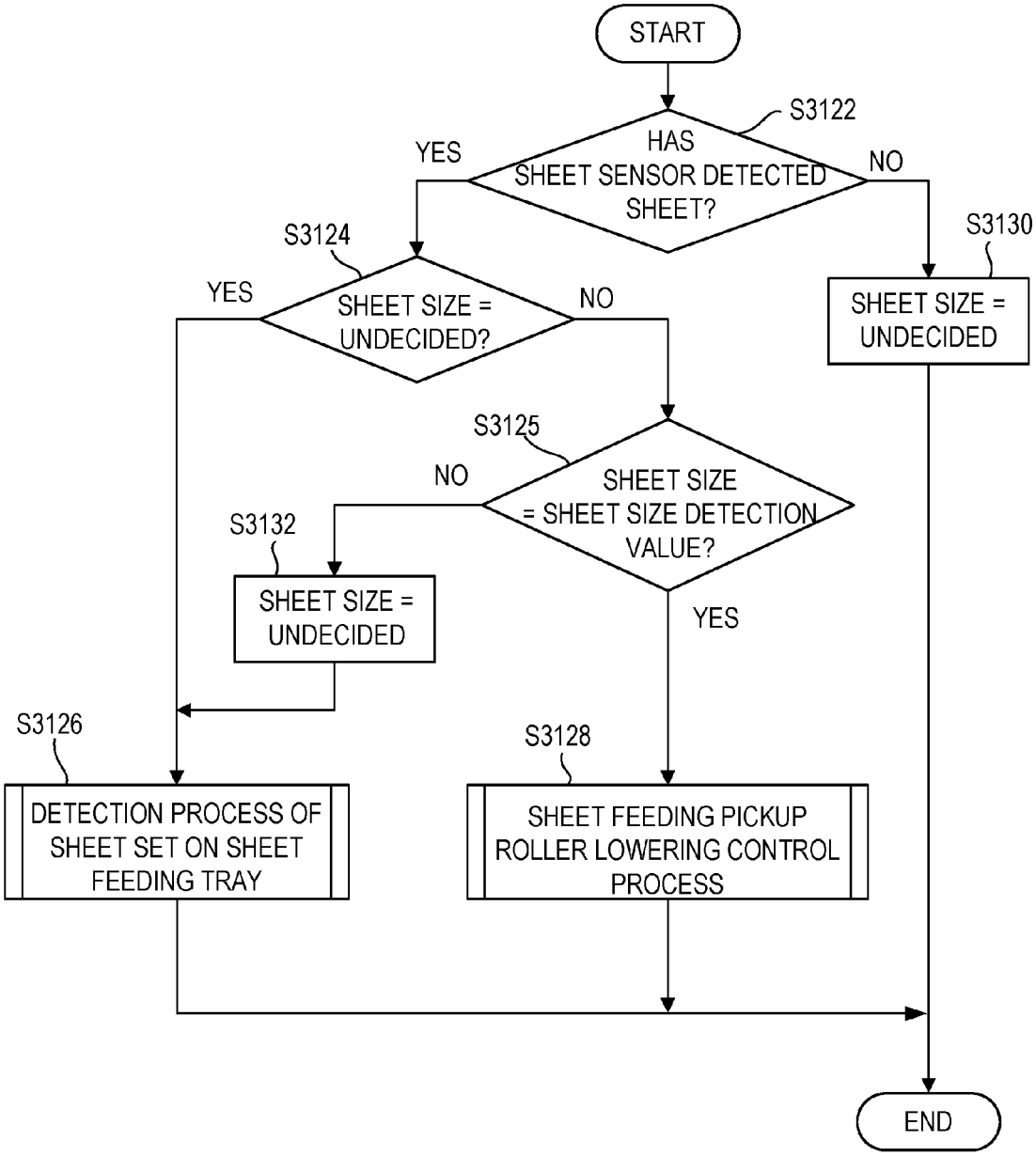
FIG. 7 is a flowchart for illustrating a control process that is performed when power is turned on according to the embodiment.

FIG. 7 is a flowchart for illustrating a control process that is performed when the image forming apparatus 100 according to the embodiment is powered on or when the mode is returned from the power saving mode to the normal mode. A mode in which the image forming apparatus 100 is operated in a normal power consumption state is referred to as the "normal power mode", whereas a mode in which the image forming apparatus 100 is operated in a smaller power consumption state than that in the normal power mode is referred to as the "power saving mode". For example, by pressing the power saving button 340 of the operating portion 330, the mode can be changed from the normal power mode to the power saving mode or returned from the power saving mode to the normal power mode. In S3122, the CPU 301 determines whether or not the sheet has been detected by the sheet sensor 115. When the CPU 301 determines in S3122 that the sheet has not been detected by the sheet sensor 115 (no sheet), the process proceeds to S3130. In S3130, the CPU 301 sets the "undecided size" as the sheet size information to be stored in the RAM 303, and then terminates the process.

When the CPU 301 determines in S3122 that the sheet has been detected by the sheet sensor 115 (presence of the sheet), the process proceeds to S3124. In S3124, the CPU 301 reads the sheet size information stored in the RAM 303 so as to determine whether or not the read sheet size information is the "undecided size". In this step, the sheet size information stored in the RAM 303 is the sheet size information before the power is turned on or the mode is changed to the power saving mode.

When the CPU 301 determines in S3124 that the sheet size information is the "undecided size", the process proceeds to S3126. The CPU 301 performs the process for detecting the placement of the sheet on the sheet feeding tray 111, which is described above referring to FIG. 6A, so as to prompt the user to decide the size of the sheet on the sheet feeding tray 111. When the CPU 301 determines in S3124 that the sheet size information stored in the RAM 303 is not the "undecided size", the process proceeds to S3125. In S3125, the CPU 301 determines whether or not the size of the sheet placed on the sheet feeding tray 111 (illustrated as "sheet size detection value" in FIG. 7), which has been detected based on the positions of the side regulating plates 421, and the sheet size information stored in the RAM (storage unit) 303 are equal to each other (match each other).

When the CPU 301 determines in S3125 that the size of the sheet placed on the sheet feeding tray 111 and the sheet size information stored in the RAM 303 are equal to each other, the process proceeds to S3128. In this case, there is a high possibility that the sheet having the same size as the decided size has been placed on the sheet feeding tray 111 before the power is turned off for the last time or before the mode is changed to the power saving mode. Therefore, the size is decided for the sheet. In S3128, the CPU 301 performs the lowering control process for the sheet feeding pickup roller 113, of moving the sheet feeding pickup roller 113 to the abutment position, which has been described referring to FIG. 6B.

When the CPU 301 determines in S3125 that the size of the sheet placed on the sheet feeding tray 111 and the sheet size information stored in the RAM 303 are not equal to each other, the process proceeds to S3132. In this case, there is a possibility that the sheet on the sheet feeding tray 111 is removed and a sheet having a different size is placed thereon during the power is turned off or during the operation in the power saving mode. In S3132, the CPU 301 sets the "undecided size" as the sheet size information to be stored in the RAM 303. Then, the process proceeds to S3126.

Through the control described above, even when a print start request is issued immediately after the mode is returned to the normal mode from the power saving mode, the size selection screen can be appropriately displayed while the FCOT is shortened.

[Print Preparation Operation]

Now, a process that is performed after the raising control for the sheet feeding pickup roller 113 is performed so that the sheet feeding pickup roller 113 is moved to the separation position after the lowering control for the sheet feeding pickup roller 113 illustrated in FIG. 6A, FIG. 6B, and FIG. 7 will be described. In control for the print preparation operation described below, the sheet feeding pickup roller 113 is moved in advance to the abutment position when the size of the sheet on the sheet feeding tray 111 is in the decided state and the operation from which the execution of the image formation is predicted has been performed. In this manner, even when the sheet feeding pickup roller 113 is temporarily moved to the separation position after the predetermined time elapses in the state in which the sheet feeding pickup roller 113 is present at the abutment position, for example, which has been described referring to FIG. 6B, the following operation can be performed. Specifically, the sheet feeding pickup roller 113 can be moved to the abutment position prior to the instruction to start printing. With the configuration described above, the sheet can be fed immediately after the instruction to start printing is input. Therefore, the FCOT can be shortened by the time period required to bring the sheet feeding pickup roller 113 into abutment with the sheet. Further, even when the sheet size is in the decided state, the lowering control process for the sheet feeding pickup roller 113 is not performed as long as the operation from which the execution of the image formation is predicted is not performed. Therefore, the sheet feeding pickup roller 113 is prevented from being unnecessarily brought into abutment with the sheet.

Here, the reason why one of the conditions for moving the sheet feeding pickup roller 113 to the abutment position is "the operation from which the execution of the image formation is predicted has been performed" will be described. In the image forming apparatus 100 according to the embodiment, in a case where the predetermined time elapses without reception of the instruction to start printing in a state in which the sheet feeding pickup roller 113 is in abutment with the sheet after the sheet feeding pickup roller 113 is moved to the abutment position, the following control is performed. Specifically, the sheet feeding pickup roller 113 is moved to the separation position. This is because, in a case where the execution of the image formation (execution of the sheet feed) is not predicted, it is unnecessary that the sheet feeding pickup roller 113 is in abutment with the sheet and there is a fear in that the mark of the sheet feeding pickup roller 113 remains on some kinds of sheets.

In such a case, for example, if the sheet feeding pickup roller 113 is moved to the abutment position only under the condition where, for example, the sheet size is in the decided state, the following problem arises. Specifically, when the predetermined time elapses after the sheet feeding pickup roller 113 is moved to the abutment position, the sheet feeding pickup roller 113 is then retracted to the separation position, as described above. However, the state in which the sheet size is decided is maintained, and hence, the sheet feeding pickup roller 113 is moved to the abutment position again. As described above, there is a fear in that the sheet feeding pickup roller 113 is repeatedly moved to the abutment position and the separation position. Therefore, in the embodiment, two conditions, specifically, "the operation from which the execution of the image formation is predicted has been performed" and "the sheet size is in the decided state", are set as the conditions for the movement of the sheet feeding pickup roller 113 to the abutment position so as to prevent unnecessary movement of the sheet feeding pickup roller 113.

[Control Process for Sheet Feeding Pickup Roller as Print Preparation Operation]

Figure 8:
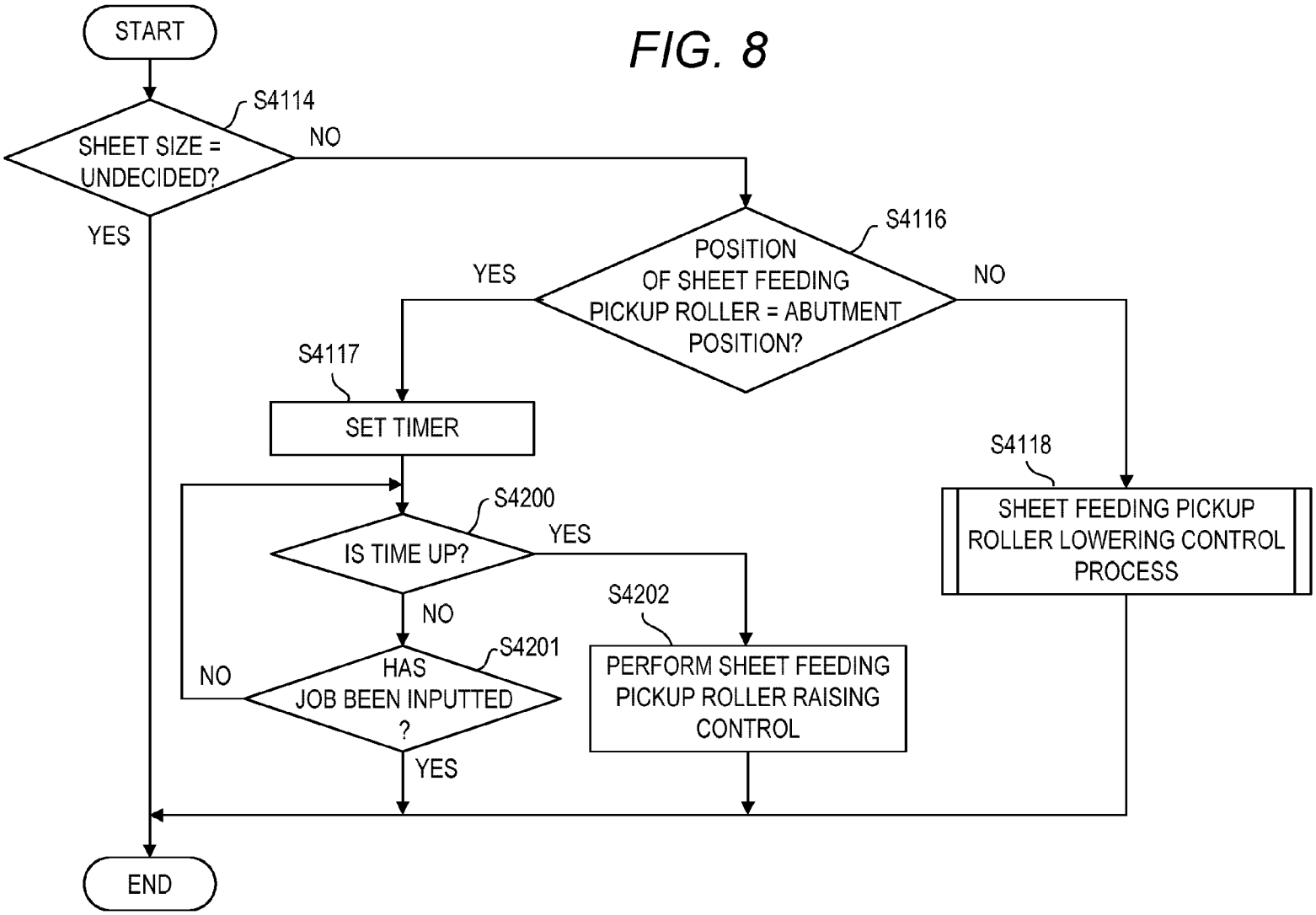
FIG. 8 is a flowchart for illustrating a control process that is performed as a print preparation operation according to the embodiment.

FIG. 8 is a flowchart for illustrating the control process as the print preparation operation. When detecting the opening and closing of the original pressure plate glass plate 55, the placement of the original, or the placement of the sheet on the sheet feeding tray 111, the CPU 301 determines that the operation from which the execution of the image formation is predicted has been performed, and therefore performs the following print preparation operation. The CPU 301 detects the opening and closing of the original pressure plate glass plate 55 or the placement of the original via the original feeder control portion 480 or the image reader control portion 280.

In S4114, the CPU 301 reads the sheet size information stored in the RAM 303 so as to determine whether or not the sheet size information is the "undecided size". When the CPU 301 determines in S4114 that the sheet size information is the "undecided size", the process is terminated. In this case, as described above referring to FIG. 6A, the CPU 301 monitors to detect whether or not the sheet is placed on the sheet feeding tray 111. When detecting the placement of the sheet, the CPU 301 performs the process illustrated in FIG. 6A. Then, when the operation from which the execution of the image formation is predicted has been performed and the size of the sheet on the sheet feeding tray 111 is in the decided state, the CPU 301 performs the lowering control for the sheet feeding pickup roller 113.

When determining in S4114 that the sheet size information is not the "undecided size", the CPU 301 then determines in S4116 whether or not the sheet feeding pickup roller 113 is present at the abutment position PR1. When the CPU 301 determines in S4116 that the sheet feeding pickup roller 113 is present at the abutment position PR1, the process proceeds to S4117. In S4117, the CPU 301 sets the predetermined time to the timer 291 as in the process performed in S2114 described above referring to FIG. 6B. The process in S4117 is performed so as to maintain the state in which the sheet feeding pickup roller 113 is present at the abutment position PR1 because it can be determined based on the execution of the print preparation operation that there is a high possibility to start printing. On the other hand, after elapse of the predetermined time, it is determined that there is a lower possibility to start printing. Therefore, control of raising the sheet feeding pickup roller 113 is performed.

In S4200, the CPU 301 determines whether or not the predetermined time has elapsed (the time set on the timer 291 is up) by referring to the timer 291. When the CPU 301 determines in S4200 that the time set on the timer 291 is up, the process proceeds to S4202. In S4202, the CPU 301 performs the raising control for the sheet feeding pickup roller 113, of moving the sheet feeding pickup roller 113 to the separation position PR2. Then, the process is terminated. Specifically, as described above referring to FIG. 5A to FIG. 5C, the CPU 301 drives the raising and lowering motor 163 until the CPU 301 detects the rising edge at which the HP sensor 167 rises from OFF to ON. In this manner, there can be prevented, for example, the mark of the sheet feeding pickup roller 113 from being left on the sheet. In this case, when it is determined that the operation from which it is predicted that the image formation is next executed has been performed in a state in which the sheet size is decided, the process illustrated in FIG. 8 is performed.

When the CPU 301 determines in S4200 that the time set on the timer 291 is not up, the process proceeds to S4201. In S4201, the CPU 301 determines whether or not the job has been input in response to the instruction to start the print operation (whether or not the instruction to start printing has been received). When the CPU 301 determines that the job has not been input, the process returns to S4200. On the other hand, when determining in S4201 that the print job has been input, the CPU 301 stops the timer that has been started in S4117 to terminate the process.

When the CPU 301 determines in S4116 that the sheet feeding pickup roller 113 is not present at the abutment position PR1, the process proceeds to S4118. In S4118, the CPU 301 performs the lowering control process for the sheet feeding pickup roller 113, which is illustrated in FIG. 6B, so as to move the sheet feeding pickup roller 113 to the abutment position PR1. Then, the control is terminated.

When the sheet feeding cassette 153 or 154 is selected in the state in which the sheet feeding pickup roller 113 is present at the abutment position PR1, the raising control for the sheet feeding pickup roller is performed.

[Control Process During Print Job]

Figure 9:
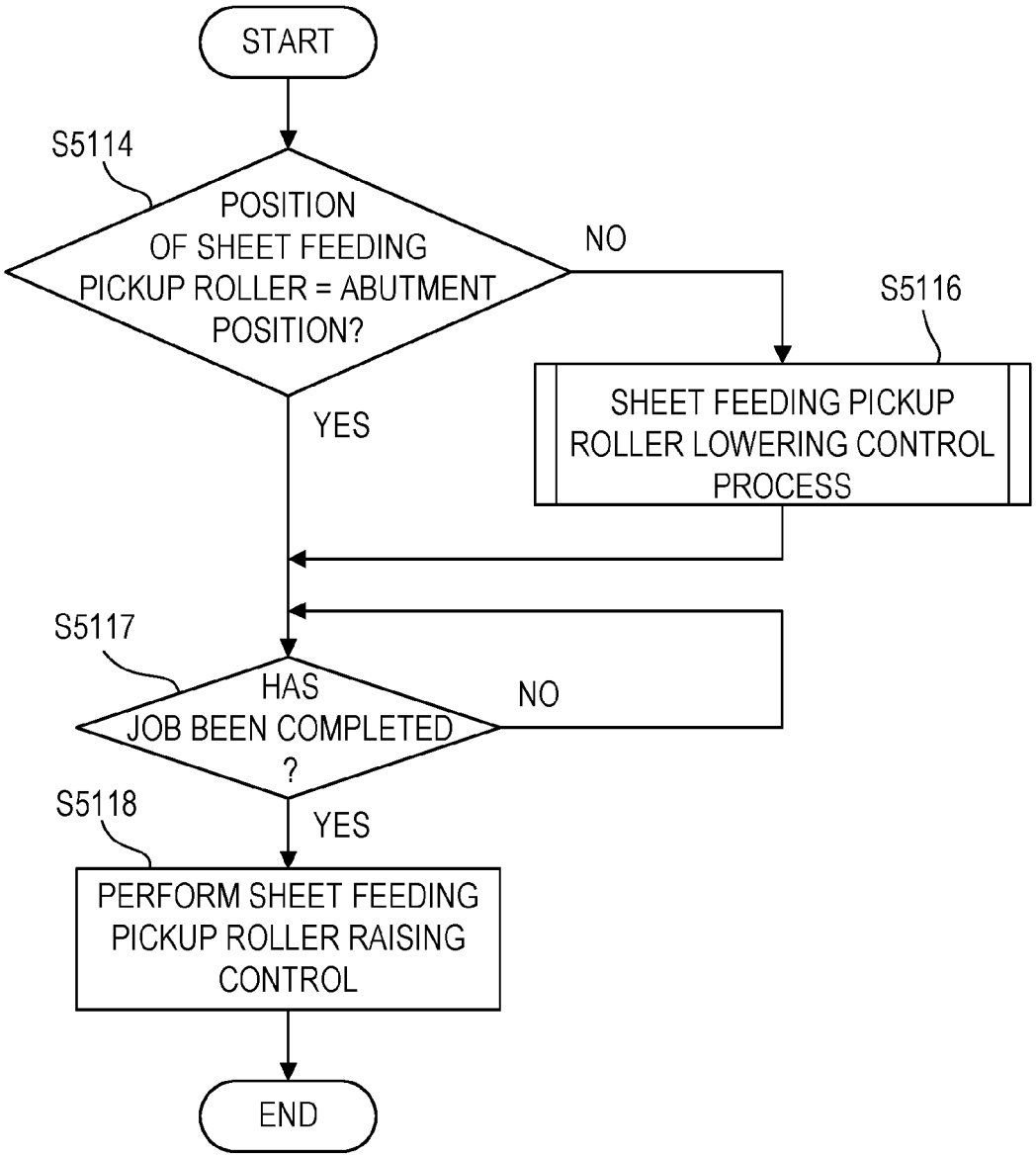
FIG. 9 is a flowchart for illustrating a control process that is performed during a print job according to the embodiment.

FIG. 9 is a flowchart for illustrating a control process performed when the print job using the sheet stacked on the sheet feeding tray 111 is started. When receiving the instruction to start the print operation, the CPU 301 performs processes from S5114 onward. In S5114, the CPU 301 determines whether or not the sheet feeding pickup roller 113 is present at the abutment position PR1. When the CPU 301 determines in S5114 that the sheet feeding pickup roller 113 is not present at the abutment position PR1, the process proceeds to S5116. In S5116, the CPU 301 performs the control of moving the sheet feeding pickup roller 113 to the abutment position PR1. As described so far, the sheet feeding pickup roller 113 is moved to the abutment position PR1 at the timing of the print preparation operation that is described above referring to FIG. 8. Therefore, in general, the process in S5116 is not performed. The process in S5116 is performed when, for example, the print job is started after elapse of the predetermined time from the end of the print preparation operation.

When the sheet feeding pickup roller 113 is moved to the abutment position PR1, the CPU 301 starts feeding the sheet on the sheet feeding tray 111. When the CPU 301 determines in S5114 that the sheet feeding pickup roller 113 is present at the abutment position PR1, the process proceeds to S5117. In S5117, the CPU 301 determines whether or not the print job has been completed. When the CPU 301 determines in S5117 that the print job has not been completed, the process in S5117 is repeated. On the other hand, when the CPU 301 determines in S5117 that the print job has been completed, the raising control of moving the sheet feeding pickup roller 113 to the separation position PR2 is performed in S5118. Then, the control is terminated.

As described above, when the sheet size changes from the undecided state to the decided state, the control is performed so that the sheet feeding pickup roller 113 and the sheet come into abutment with each other even before the print start is instructed. As a result, the sheet feeding pickup roller 113 and the sheet are in abutment with each other, and hence the sheet can be fed immediately after the input of the print start instruction. Therefore, the FCOT is shortened by the time period required to bring the sheet feeding pickup roller 113 into abutment with the sheet.

Further, the control may be performed so that the sheet feeding pickup roller 113 and the sheet are brought into abutment with each other even before the print start is instructed when the operation from which the execution of the image formation is predicted has been performed and the size of the sheet on the sheet feeding tray 111 is in the decided state. In this manner, the sheet feeding pickup roller 113 and the sheet are in abutment with each other, and hence the sheet can be fed immediately after the input of the print start instruction. Therefore, the FCOT is shortened by the time period required to bring the sheet feeding pickup roller 113 into abutment with the sheet. Further, when the operation from which the execution of the image formation is predicted has not been performed even in the state in which the sheet size is decided, the lowering control for the sheet feeding pickup roller 113, of moving the sheet feeding pickup roller 113 to the abutment position, is not performed. Therefore, the sheet feeding pickup roller 113 is prevented from being unnecessarily brought into abutment with the sheet.

As described above, according to the embodiment, the first copy output time can be shortened.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-102886, filed May 20, 2015, and Japanese Patent Application No. 2015-102885, filed May 20, 2015, which are hereby incorporated by reference herein in their entirety.

What is claimed is:

1. An image forming apparatus, comprising:

an image forming control portion;

a stacking portion on which a recording medium is stacked;

a sheet feeding member configured to feed the recording medium stacked on the stacking portion to a conveyance path;

a change unit configured to change a state of the sheet feeding member and the recording medium between a first state in which the sheet feeding member and the recording medium stacked on the stacking portion are in abutment with each other and a second state in which the sheet feeding member and the recording medium stacked on the stacking portion are separated from each other;

a decision unit configured to decide a size of the recording medium stacked on the stacking portion; and a controller configured to control the change unit so that, when the size of the recording medium is changed from an undecided state to a decided state by the decision unit, the state of the sheet feeding member and the recording medium is changed from the second state to the first state even without an instruction to start image formation from the image forming control portion, wherein the controller controls the change unit so that, when a predetermined time elapses without the instruction to start the image formation after the state of the sheet feeding member and the recording medium is changed from the second state to the first state by the change unit, the state of the sheet feeding member and the recording medium is changed from the first state to the second state.

2. An image forming apparatus according to claim 1, wherein the change unit comprises a drive unit configured to raise and lower the sheet feeding member so that the state of the sheet feeding member and the recording medium is changed between the first state and the second state.

3. An image forming apparatus according to claim 1, wherein the change unit comprises a drive unit configured to raise and lower the stacking portion so that the state of the sheet feeding member and the recording medium is changed between the first state and the second state.

4. An image forming apparatus according to claim 1, further comprising:

a first detection unit configured to detect information for deciding the size of the recording medium stacked on the stacking portion;

a display portion configured to display candidate sizes of the recording medium stacked on the stacking portion based on the information detected by the first detection unit; and a selection portion configured to select the size of the recording medium from the candidate sizes displayed on the display portion by a manual operation, wherein the decision unit is configured to decide the size of the recording medium stacked on the stacking portion in response to a selection of the size of the recording medium by the selection portion.

5. An image forming apparatus according to claim 1, further comprising a detection unit configured to detect that the recording medium is stacked on the stacking portion, wherein the controller is configured to determine that the size of the recording medium is in the undecided state when it cannot be detected by the detection unit that the recording medium is stacked on the stacking portion.

6. An image forming apparatus according to claim 1, wherein the stacking portion comprises a stacking portion for manual feed.

7. An image forming apparatus according to claim 1, further comprising a determination unit configured to determine whether or not an operation from which execution of the image formation is predicted is performed, wherein the controller controls the change unit so that, when the determination unit determines that the operation is performed after the state of the sheet feeding member and the recording medium is changed from the first state to the second state by the change unit due to an elapse of the predetermined time and when the size of the recording medium is decided by the decision unit, the state of the sheet feeding member and the recording medium is changed from the second state to the first state even without the instruction to start the image formation.

8. An image forming apparatus, comprising:

an image forming control portion;

a stacking portion on which a recording medium is stacked;

a sheet feeding member configured to feed the recording medium stacked on the stacking portion to a conveyance path;

a change unit configured to change a state of the sheet feeding member and the recording medium between a first state in which the sheet feeding member and the recording medium stacked on the stacking portion are in abutment with each other and a second state in which the sheet feeding member and the recording medium stacked on the stacking portion are separated from each other;

a storage unit configured to store information on the size of the recording medium;

a decision unit configured to decide a size of the recording medium stacked on the stacking portion; and a controller configured to control the change unit so that, when the size of the recording medium is changed from an undecided state to a decided state by the decision unit, the state of the sheet feeding member and the recording medium is changed from the second state to the first state even without an instruction to start image formation from the image forming control portion, wherein the controller is configured to determine that the size of the recording medium is in the undecided state when the information on the size of the recording medium, which is stored in the storage unit, does not match the size of the recording medium, which is decided by the decision unit.

9. An image forming apparatus, comprising:

an image forming control portion;

a stacking portion on which a recording medium is stacked;

a sheet feeding member configured to feed the recording medium stacked on the stacking portion to a conveyance path;

a change unit configured to change a state of the sheet feeding member and the recording medium between a first state in which the sheet feeding member and the recording medium stacked on the stacking portion are in abutment with each other and a second state in which the sheet feeding member and the recording medium stacked on the stacking portion are separated from each other;

a decision unit configured to decide a size of the recording medium stacked on the stacking portion;

a determination unit configured to determine whether or not an operation from which execution of image formation is predicted is performed; and a controller configured to control the change unit so that, when the determination unit determines that the operation is performed and the size of the recording medium is decided by the decision unit, the state of the sheet feeding member and the recording medium is changed from the second state to the first state even without an instruction to start the image formation from the image forming control portion, wherein the controller controls the change unit so that, when a predetermined time elapses without the instruction to start the image formation after the state of the sheet feeding member and the recording medium is changed from the second state to the first state by the change unit, the state of the sheet feeding member and the recording medium is changed from the first state to the second state.

10. An image forming apparatus according to claim 9, wherein the change unit comprises a drive unit configured to raise and lower the sheet feeding member so that the state of the sheet feeding member and the recording medium is changed between the first state and the second state.

11. An image forming apparatus according to claim 9, wherein the change unit comprises a drive unit configured to raise and lower the stacking portion so that the state of the sheet feeding member and the recording medium is changed between the first state and the second state.

12. An image forming apparatus according to claim 9, further comprising a reading portion configured to read an image of an original, wherein, when detecting a placement of the original on the reading portion, the determination unit determines that the operation from which the execution of the image formation is predicted is performed.

13. An image forming apparatus according to claim 9, further comprising an operating portion to be operated so as to set an operation mode for the image formation, wherein, when the operating portion is operated, the determination unit determines that the operation from which the execution of the image formation is predicted is performed.

14. An image forming apparatus according to claim 9, wherein, when the recording medium is placed on the stacking portion, the determination unit determines that the operation from which the execution of the image formation is predicted is performed.

15. An image forming apparatus according to claim 9, further comprising:

a detection unit configured to detect information for deciding the size of the recording medium stacked on the stacking portion;

a display portion configured to display candidate sizes of the recording medium stacked on the stacking portion based on the information detected by the detection unit; and a selection portion configured to select the size of the recording medium from the candidate sizes displayed on the display portion by a manual operation, wherein the decision unit is configured to decide the size of the recording medium stacked on the stacking portion in response to a selection of the size of the recording medium by the selection portion.

16. An image forming apparatus according to claim 9, wherein the stacking portion comprises a stacking portion for manual feed.

* * * * *